US006295764B1

(12) United States Patent
Berridge et al.

(10) Patent No.: US 6,295,764 B1
(45) Date of Patent: Oct. 2, 2001

(54) STACKABLE WALL PANEL SYSTEM

(75) Inventors: Philip Longstreet Berridge, Allendale; Scott Walter Compton, Grand Haven; Bruce Robert Gezon, Caledonia; Anthony David Lufkin, Paw Paw; Shane Michael Ramsdell, Lowell, all of MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 09/586,142

(22) Filed: Jun. 2, 2000

Related U.S. Application Data

(60) Provisional application No. 60/137,807, filed on Jun. 4, 1999.

(51) Int. Cl.[7] ..... E04B 2/74

(52) U.S. Cl. ..... 52/36.5; 52/238.1; 52/239; 160/135

(58) Field of Search ..... 52/238.1, 243.1, 52/136, 220.7, 239, 584.1, 591.3, 586.1, 800.11, 236.3, 236.7, 726.1, 726.3, 762; 160/135

(56) References Cited

U.S. PATENT DOCUMENTS

| | | |
|---|---|---|
| Re. 32,890 | 3/1989 | DeFouw et al. . |
| 2,970,677 | 2/1961 | Springs, Jr. et al. . |
| 3,066,770 | 12/1962 | Millard et al. . |
| 3,180,459 | 4/1965 | Liskey, Jr. . |
| 3,228,157 | 1/1966 | Jacobson . |
| 3,261,625 | 7/1966 | Cripe . |
| 3,370,389 | 2/1968 | Macaluso . |
| 3,430,997 | 3/1969 | Propst et al. . |
| 3,477,492 | 11/1969 | Suess . |
| 3,486,287 | 12/1969 | Guillon . |
| 3,517,467 | 6/1970 | Propst et al. . |
| 3,546,834 | 12/1970 | Murawski . |
| 3,550,337 | 12/1970 | Lorenz . |
| 3,553,916 | 1/1971 | Lickliter et al. . |
| 3,621,635 | 11/1971 | DeLange . |
| 3,691,709 | 9/1972 | Ostborg . |
| 3,745,732 | 7/1973 | Pritchard et al. . |
| 3,789,567 | 2/1974 | Rae et al. . |
| 3,987,836 | 10/1976 | LeMay . |
| 4,030,219 | 6/1977 | Donovan . |
| 4,056,903 | 11/1977 | Guarnere . |
| 4,104,838 | 8/1978 | Hage et al. . |
| 4,120,124 | 10/1978 | Temple et al. . |
| 4,245,442 | 1/1981 | Durham . |
| 4,308,695 | 1/1982 | Ehrsam . |
| 4,391,069 | 7/1983 | Vermillion . |
| 4,391,073 | 7/1983 | Mollenkopf et al. . |
| 4,406,101 | 9/1983 | Heidmann . |
| 4,434,596 | 3/1984 | McAteer et al. . |

(List continued on next page.)

OTHER PUBLICATIONS

"Ethospace Interiors Planning Guide, 1st Edition," Herman Miller, Source Book © 1985, pp. 1–107.
"Action Office® Planning Guide Series 2 Panels," Herman Miller Planning Guide, Jul. 1991.
"Action Office® Series 3 Panels," Herman Miller Planning Guide, Jan. 1993.

*Primary Examiner*—Carl D. Friedman
*Assistant Examiner*—Chi Nguyen
(74) *Attorney, Agent, or Firm*—Brinks Hofer Gilson & Lione

(57) ABSTRACT

A stackable wall panel system including at least one upper and lower wall panel, a first and second corner post and an insert. The insert threadably engages an upper portion of the first corner post, and the second corner post is disposed on the first corner post over the insert. A connector connects the second corner post and the insert. One or more upper wall panels are connected to a pair of lower wall panels with an alignment clip, a pair of draw blocks and a draw rod.

22 Claims, 12 Drawing Sheets

U.S. PATENT DOCUMENTS 4,448,003 5/1984 Hasbrouck .
4,535,577 8/1985 Tenser et al. .
4,545,168 * 10/1985 Dalton, Jr. ..... 52/588
4,557,091 12/1985 Auer .
4,571,907 2/1986 DeFouw et al. .
4,573,513 3/1986 Small et al. .
4,601,146 7/1986 Harter et al. .
4,625,476 12/1986 Shimada .
4,631,881 12/1986 Charman .
4,644,993 2/1987 Cooper et al. .
4,709,517 12/1987 Mitchell et al. .
4,712,336 12/1987 Backer .
4,716,699 1/1988 Crossman et al. .
4,719,730 1/1988 Winkowski .
4,771,583 9/1988 Ball et al. .
4,821,477 4/1989 Rydqvist .
4,821,788 4/1989 Nelson .
4,860,812 8/1989 DePietro et al. .
4,881,349 11/1989 Brown et al. .
4,905,334 3/1990 Oppenhuizen .
4,905,428 3/1990 Sykes .
4,907,384 3/1990 Underwood .
4,914,873 4/1990 Newhouse .
4,914,878 4/1990 Tamaki et al. .
4,936,066 6/1990 Rutsche et al. .
4,947,601 8/1990 McGuire .
4,962,805 10/1990 Allen .
4,993,205 2/1991 Dull et al. .
5,009,043 4/1991 Kurrasch .
5,025,603 6/1991 Johnson .
5,038,539 8/1991 Kelley et al. .
5,056,285 10/1991 Frascaroli et al. .
5,056,577 10/1991 Delong et al. .
5,058,347 * 10/1991 Schuelke et al. ..... 52/339
5,060,434 10/1991 Allison .
5,062,246 11/1991 Sykes .
5,065,556 11/1991 DeLong et al. .
5,067,294 11/1991 McGowan .
5,069,263 12/1991 Edwards .
5,070,666 12/1991 Looman .
5,088,541 2/1992 Persing et al. .
5,134,826 8/1992 LaRoche et al. .
5,159,793 11/1992 Duego et al. .
5,174,086 12/1992 Payne et al. .
5,175,969 1/1993 Knauf et al. .
5,216,859 6/1993 Moreno et al. .
5,251,413 10/1993 Goodman .
5,274,970 1/1994 Roberts .
5,277,005 1/1994 Hellwig et al. .
5,277,007 1/1994 Hellwig et al. .
5,285,602 2/1994 Felton .
5,287,666 2/1994 Frascaroli et al. .
5,305,567 4/1994 Wittler .
5,377,461 1/1995 DeGrada et al. .
5,382,719 1/1995 Fagan .
5,394,558 2/1995 Arakawa et al. .
5,394,658 3/1995 Schreiner et al. .
5,394,668 3/1995 Lim .
5,400,560 3/1995 Hellwig et al. .
5,406,760 4/1995 Edwards .
5,430,984 7/1995 Young et al. .
5,433,046 7/1995 MacQuarrie et al. .
5,487,246 1/1996 Hodges et al. .
5,490,357 2/1996 Lin .
5,491,943 2/1996 Vondrejs et al. .
5,546,718 8/1996 Way .
5,561,960 10/1996 Minnick et al. .
5,562,469 10/1996 Nienhuis et al. .
5,586,593 12/1996 Schwartz .
5,600,926 2/1997 Ehrlich .
5,603,370 2/1997 Boer .
5,634,305 6/1997 Erlanger .
5,638,650 6/1997 Edwards .
5,638,653 6/1997 Rossi .
5,642,593 7/1997 Shieh .
5,644,878 7/1997 Wehrmann .
5,657,885 8/1997 White et al. .
5,682,719 11/1997 Huang .
5,687,859 11/1997 Miller .
5,692,345 12/1997 Mogaki et al. .
5,724,779 3/1998 Chang .
5,737,887 4/1998 Smeenge .
5,737,893 4/1998 Rossiter et al. .
5,746,034 5/1998 Luchetti et al. .
5,746,035 5/1998 Seiber et al. .
5,802,789 9/1998 Goodman et al. .
5,806,258 9/1998 Miedema et al. .
5,809,714 9/1998 Kurrasch et al. .
5,809,715 9/1998 Tanaka .
5,839,240 11/1998 Elsholz et al. .
5,852,904 12/1998 Yu et al. .
5,867,955 2/1999 Russell .
5,870,867 2/1999 Mitchell .
5,896,710 4/1999 Hoyle .
5,899,025 5/1999 Casey et al. .
5,899,035 5/1999 Waalkes et al. .
5,918,422 * 7/1999 Bucher, Jr. ..... 52/36.5
5,930,963 8/1999 Nichols .
5,974,742 11/1999 Schreiner et al. .
6,000,179 12/1999 Musculus et al. .
6,003,273 12/1999 Esholz et al. .
6,009,675 1/2000 Waalkes et al. .
6,009,676 1/2000 Feldpausch et al. .
6,047,509 4/2000 Savoie .
6,052,958 4/2000 Miedema et al. .

* cited by examiner 764
769
766
768
767
784
782
780
760
762
770
790
800
802
804
136
80

1510
1506
1502
1512
1504
1508
1503
1500
1502
1504
1506
1508
1503
402
770
190
90
1200
110
70
90
1000
52
70
600
56
770
500
402
52
290
220
110
250
1500
220
250
860
900
52
90

STACKABLE WALL PANEL SYSTEM

This application claims the benefit of U.S. Provisional Application No. 60/137,807 filed Jun. 4, 1999, which application is hereby incorporated herein by reference.

BACKGROUND OF THE INVENTION

The present invention relates generally to a wall panel system, and in particular, to stackable wall panel system comprised of upper wall panels disposed on and overlying lower wall panels.

Panel systems are commonly used to divide large, open office space into separate workspaces. For example, Herman Miller, Inc., the assignee of the present application, manufacturers and sells two such work space management systems: the ACTION OFFICE® system and the ETHOSPACE® system. Typically, workspace management systems are comprised of a series of wall panels arranged in various configurations. For example, wall panels can be connected in series in an end-to-end configuration, or they can be arranged around and connected to a corner post in a two-way, three-way or four-way configuration. Often, it is desirable to provide wall panels of differing heights so as to allow the user of the workspace to have flexibility in configuring the work space. For example, shorter wall panels can be used to ease and promote communication with a user of the workspace, e.g., at a reception area. Conversely, taller wall panels can be used to provide greater privacy for the user.

In other systems, upper wall panels can be arranged above lower wall panels so as to allow the user to reconfigure the workspace. In this way, the height of a wall panel defining in part the workspace can be altered with stackable upper wall panels, rather than removing entirely a lower wall panel and replacing it with a taller or shorter wall panel. Often, however, the addition or removal of stackable upper wall panels can involve complex, multiple parts and require excessive amounts of time and manpower to effect the necessary or desired change.

SUMMARY OF THE INVENTION

Briefly stated, one aspect of the invention is directed to an improved system of wall panels, including at least one upper and lower wall panel and a first and second corner post. The first corner post comprises an upper portion. An insert comprises a first end that threadably engages the upper portion and a second end that extends upwardly therefrom. The second corner post is disposed on the first corner post over the insert, and a connector engages the second post member and threadably engages the second end of the insert. The upper and lower wall panels are connected to the first and second corner posts respectively.

In another aspect, a pair of upper wall panels overlie a pair of lower wall panels, with each of the pairs of upper and lower wall panels arranged in an end-to-end configuration respectively. The lower wall panels each have a channel formed along a top portion thereof. A first draw block is disposed in the channels of the lower panels and is attached to the top portions thereof. Each of the upper wall panels includes an alignment clip mounted to the bottom thereof. The alignment clip includes a resilient portion that engages a lip portion formed along an upper edge of the lower wall panel channel. A second draw block and draw rod are used to connect the upper wall panels to one another and to the first draw block.

In yet another aspect, an end-of-the-run upper wall panel is connected to an underlying lower wall panel with an upper and lower draw block and a draw rod. The lower draw block is mounted in a channel formed in the underlying lower wall panel. In a preferred embodiment, an alignment clip attached to a bottom of the upper wall panel engages a portion of the lower wall panel.

The present invention provides significant advantages over other wall panel systems. In particular, the second corner post can be easily and quickly installed on the first corner post, thereby providing the user with the ability to easily reconfigure a workspace by adding or removing stackable upper wall panels. In addition, the second corner post can be installed without having to disassemble the connection between any lower wall panels and the first corner post. Similarly, upper wall panels can be quickly and easily installed in an overlying relationship with lower wall panels through the use of various draw blocks and draw rods, which are easy to manipulate and which are largely interchangeable as between various panel-to-panel and panel-to-corner post interfaces. Moreover, the upper wall panels can be installed without having to disassemble the connection between the lower wall panels. The alignment clip also provides the important advantage of maintaining the alignment of an upper wall panel on an underlying lower wall panel so as to improve the aesthetics of the system.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

Figure 1:
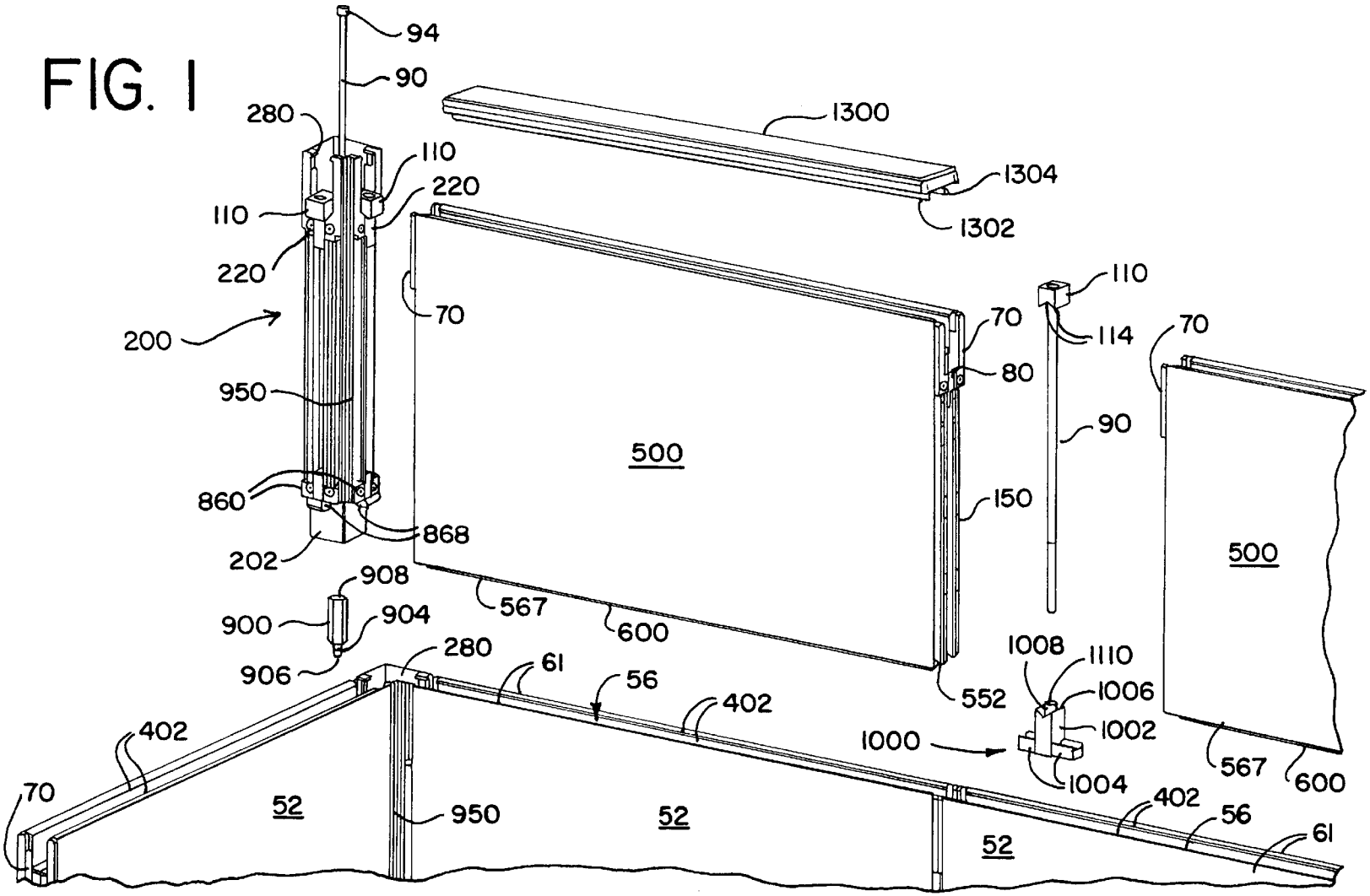
FIG. 1 is an exploded perspective view of one configuration of a stackable wall panel system including a pair of upper wall panels overlying a pair of lower wall panels.

Referring to the drawings, FIG. 1 shows a stackable wall system including a pair of lower wall panels 52 connected to one another in an end-to-end configuration, with one of the lower wall panels further connected to a corner post with a corner connecting system 200. A third lower wall panel 52 is connected to and extends from the corner post at an approximate right angle to the pair of end-to-end lower wall panels. The connector systems for connecting the lower wall panels to one another and to the corner post is disclosed in U.S. Pat. No. 5,058,347, which issued Oct. 22, 1991 and is assigned to Herman Miller, Inc., the same assignee as for the present application, and which is hereby incorporated herein by reference. Also incorporated herein by reference is U.S. application Ser. No. 60/137,809 entitled "Stackable Wall Panel System," filed Jun. 4, 1999 and naming the same inventors named on this application.

Figure 16:
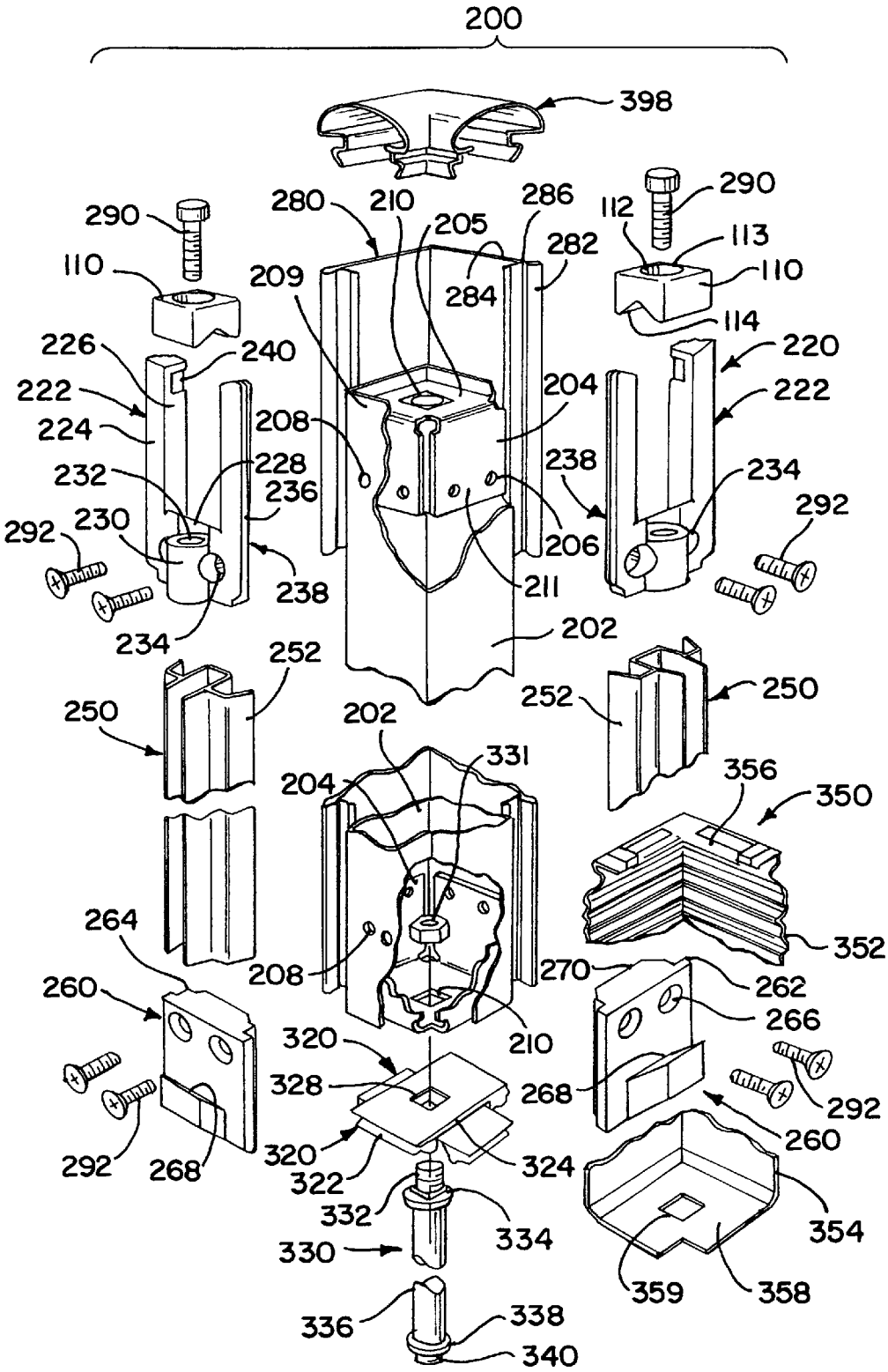
FIG. 16 is an exploded view of a lower corner post and connector system, with portions of the lower corner post partially broken away.
Figure 17:
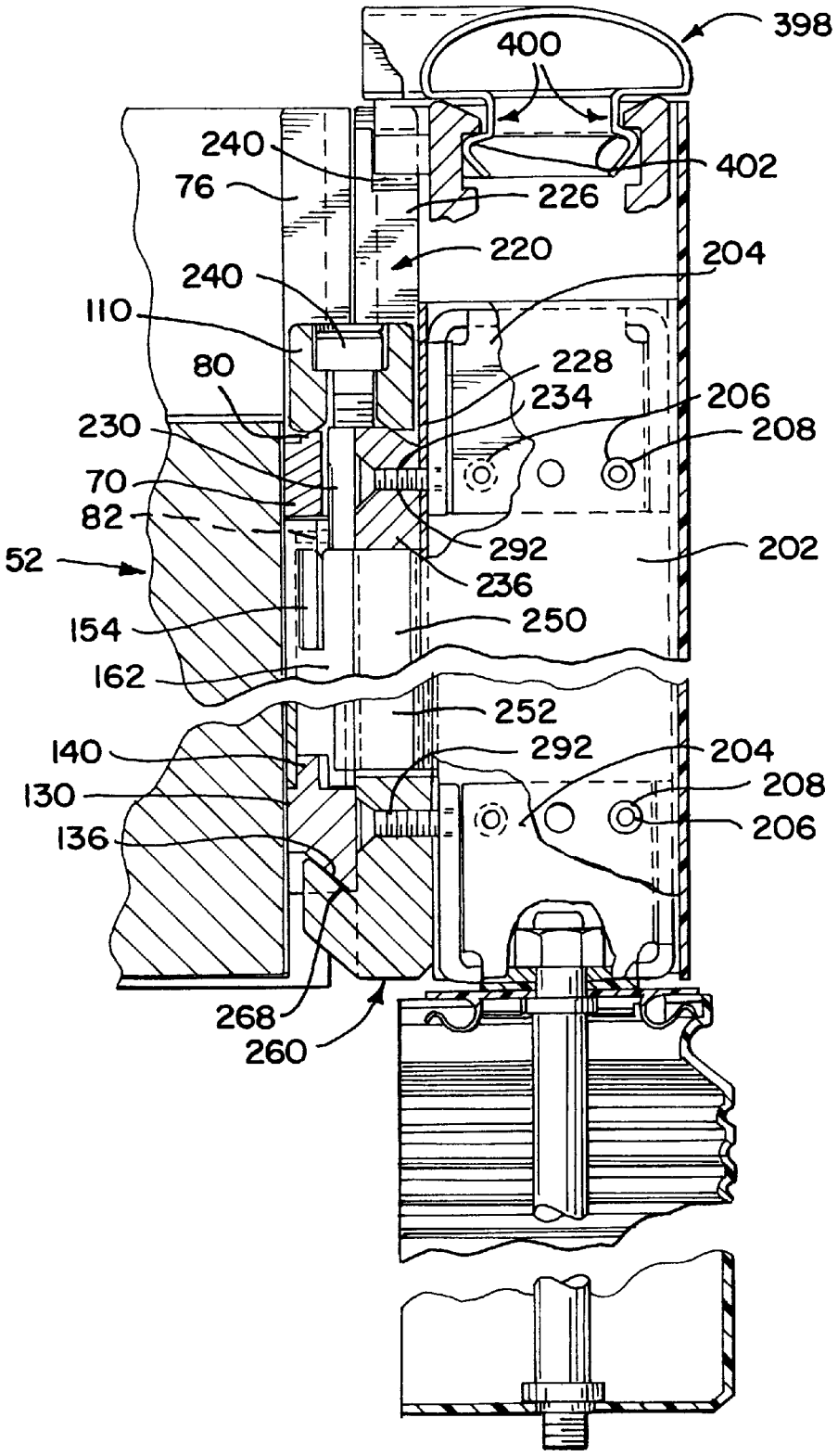
FIG. 17 is a cross-sectional, front elevation view of a lower corner post connected to a lower wall panel.

In particular, and referring to FIGS. 16 and 17, the corner post includes a post member 202 configured as a tube and a bracket 204 mounted in the upper portion 209 of the tube. The bracket includes a horizontal plate 205 and four vertical mounting flanges 211, which are secured to the inside walls of the tube. The plate 205 has a square opening 210, which is preferably unthreaded, formed in the approximate middle thereof. Alternatively, it should be understood that the opening can be configured in other shapes, and can be either threaded or unthreaded.

An upper wedge block 220 is mounted to each side of the tube that is intended to be connected with an adjacent lower wall panel with a pair of fasteners 292 which extend through holes 208 in the tube and engage holes 206 in the bracket 204. In this way, the post member 202 can be configured to support a lower wall panel on one or more sides thereof, including one side, two opposite sides, two adjacent sides, three sides or four sides. In particular, the corner post can connect two, three, or four panels at various right angles or in line with each other simply by providing wedge blocks along those sides of the corner post that are to be connected to the wall panels.

The upper wedge block has a base 238, a channel wing 222, a stop flange 224, a channel flange 226, a wedge or draw surface 228, and screw holes 234. Preferably, the draw surface is upwardly inclined, preferably at an angle of about 45 degrees to the vertical, and is planar. It should be understood that other angles of inclination would work also be suitable. The base includes a threaded arcuate extension 230 having a threaded receiving opening 232 and a receiving flange 236 which extends from the base 238. Alternatively, the base can be configured with a male threaded stud extending upwardly from the base, rather than the female threaded receiving opening.

A lower draw block 260 is mounted to each side of the tube that is intended to be connected with a wall panel along a bottom portion thereof below the upper wedge block 220. The lower draw block 260 includes a base 270, a stop flange 262, receiving flanges 264, and screw holes 266. The lower draw block further includes a draw portion having an upwardly extending wedge or draw surface 268. The draw surface is again preferably upwardly inclined, preferably at an angle of 45 degrees to the vertical, and is planar. Again, it should be understood that other angles of inclination would also work. A filler extrusion 250 is attached to the tube between the upper and lower wedge blocks with adhesive or fasteners.

Figure 18:
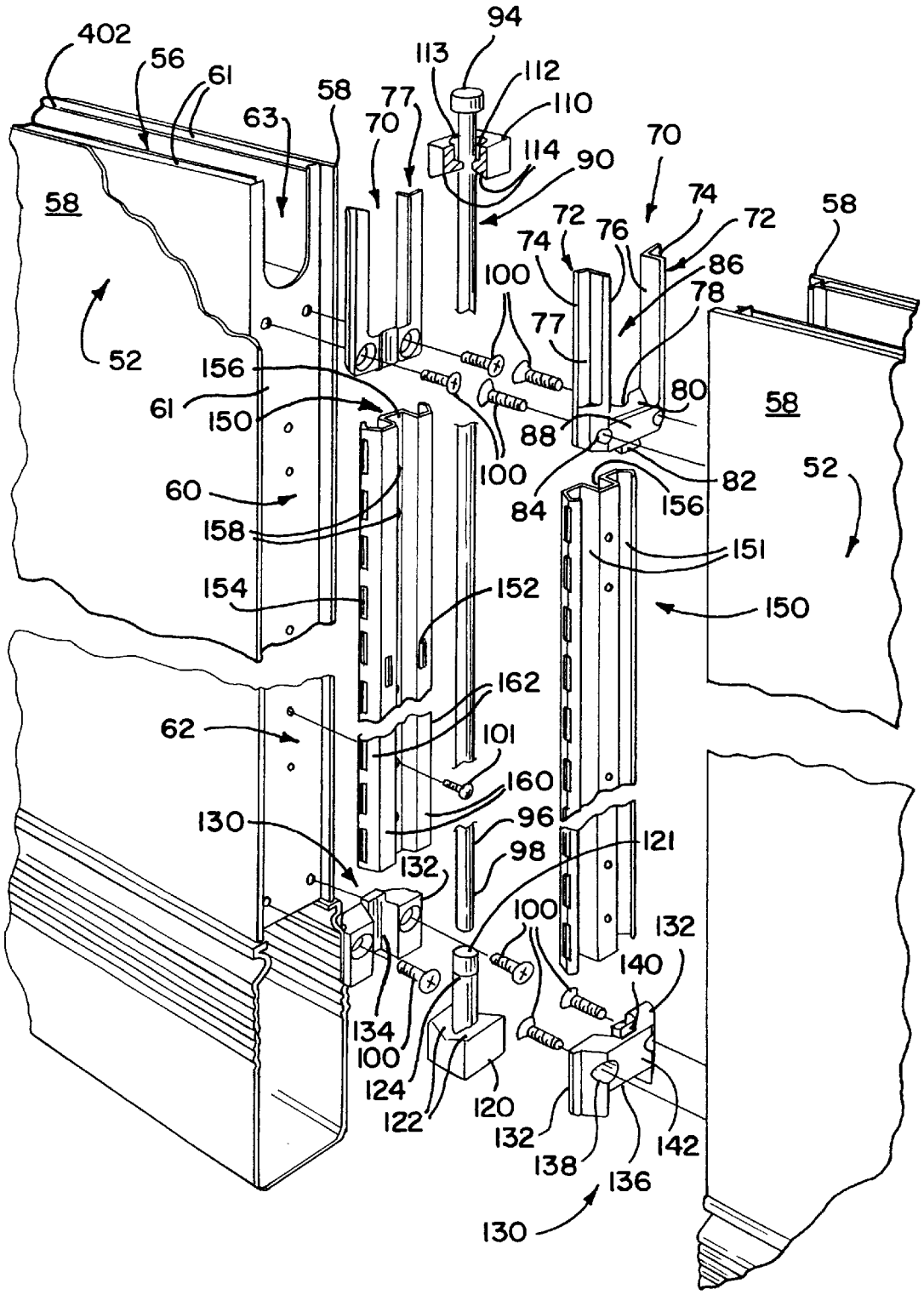
FIG. 18 is an exploded view of a connector system with two lower wall panels arranged in an end-to-end configuration.
Figure 19:
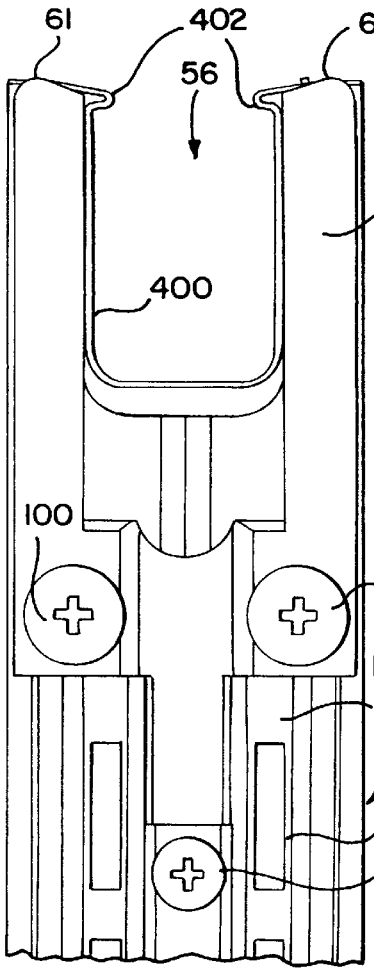
FIG. 19 is an enlarged partial end view of the top portion of the upper wall panel shown in FIG. 10.
Figure 20:
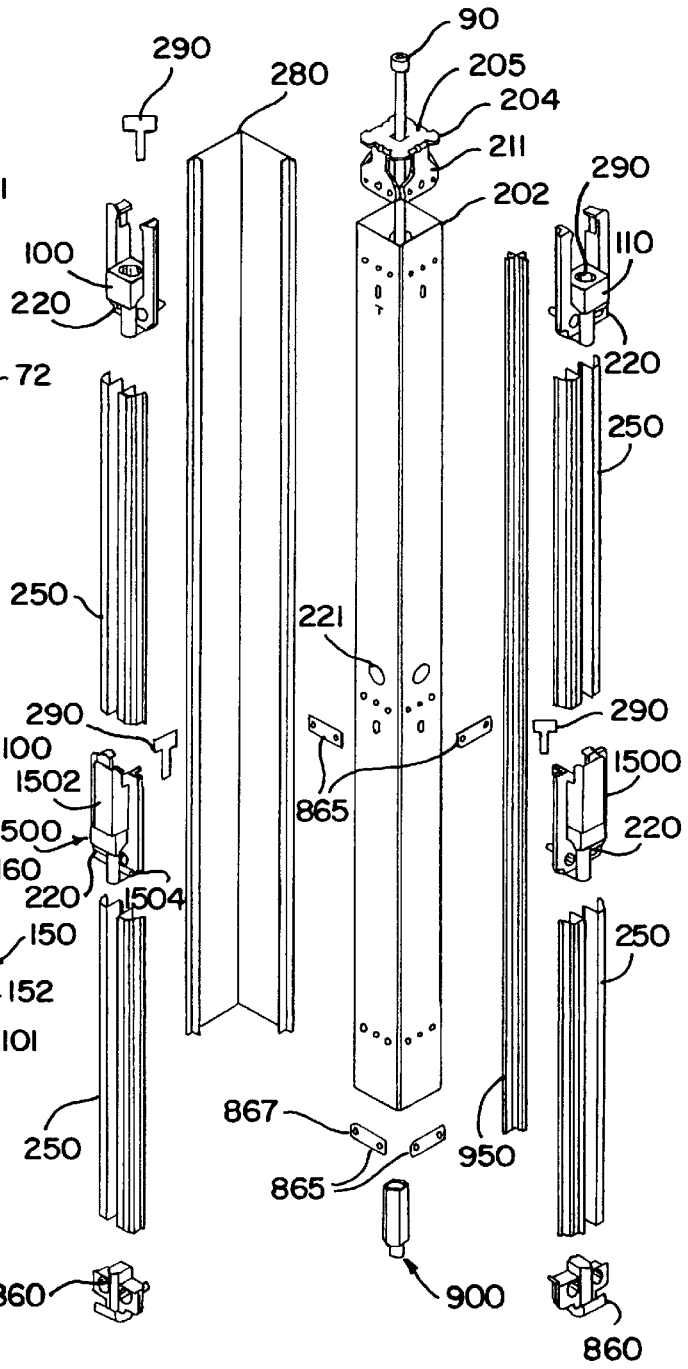
FIG. 20 is an exploded perspective view of an alternative embodiment of an upper corner post and connector system.

Referring to FIG. 18, a pair of lower wall panels 52 arranged in an end-to-end configuration are shown. An upper wedge block 70 is attached to each end of each lower wall panel along an upper portion thereof with a plurality of screws 100. The upper wedge block 70 includes a base 88 from which extend channel legs 72, a wedge or draw surface 80, and a shaft guide extension 82. The channel legs 72 are formed by stop flanges 74 and channel flanges 76. A U-shaped channel 86 is formed by a the base 88 and the channel flanges 76. The draw surface 80 is preferably upwardly inclined, preferably at an angle of 45 degrees to the vertical (although other angles would also be suitable), and is planar. A semi-annular shaft guide 78 is formed in the draw surface 80, base 88, and shaft guide extension 82.

A lower wedge block 130 is attached to each end of each lower wall panel 52 below the upper wedge block 70 with a pair of screws 100. The lower wedge block 130 includes a base 142 with stop flanges 132, a draw or wedge surface 136 and shaft guide extension 140 extending therefrom. The draw surface is preferably downwardly inclined, preferably at an angle of 45 degrees to the vertical (although other angles would also be suitable), and is planar. A half-cylindrical shaft guide 134 is formed in the draw surface 136, the base 142, and the shaft guide extension 140.

A hanger bracket 150, otherwise referred to as a frame hanger, is attached to each end of the lower panel 52 with fasteners 101 between the upper wedge block 70 and the lower wedge block. The hanger bracket 150 is preferably W-shaped in cross-section and includes a pair of inwardly facing channels 151 and an outwardly facing channel 156 formed therebetween. End slots 152 are formed in front surfaces 160 of the channels 151, while accessory slots 154 are spaced along a side flange 162 of the hanger bracket that extends outwardly and backwardly from the front surfaces 160. Alternatively, the accessory slots can be positioned along the corner interfacing the side flange and the adjacent front surface. Accessories such as shelving, overhead cabinets and the like (not shown) are configured to engage the accessory slots 152 formed in the hanger brackets.

Figure 8:
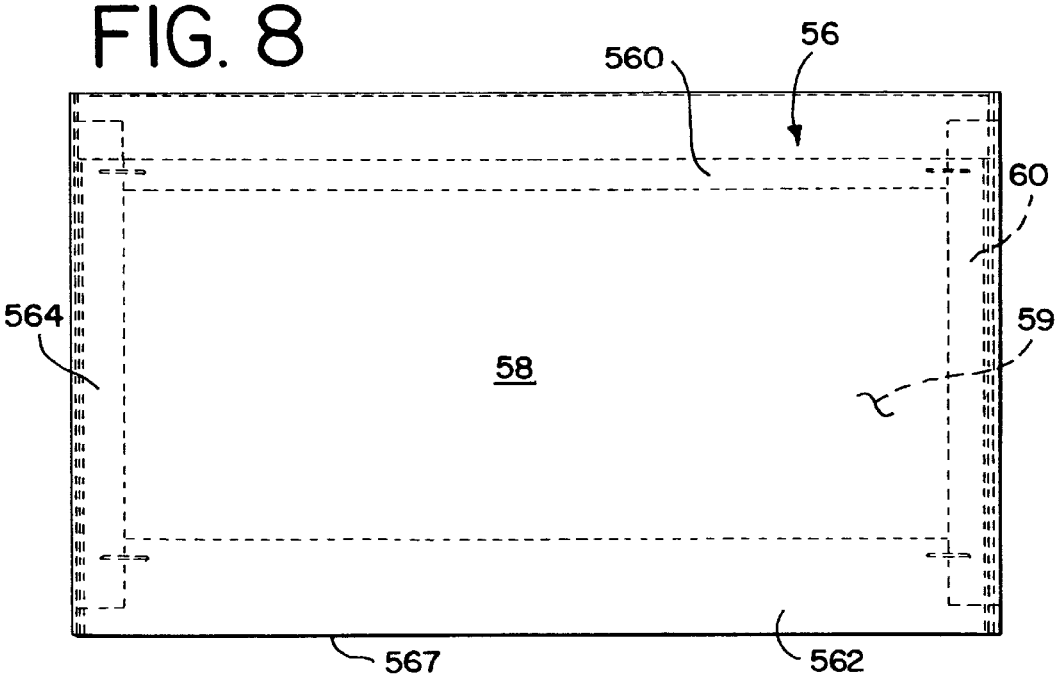
FIG. 8 is a side view of one embodiment of a wall panel core.

Referring to FIGS. 8 and 18, the lower wall panels 52 are preferably comprised of a frame 60 constructed around the edges of the panel. The frame is preferably formed from side vertical frame members 564 and upper and lower horizontal frame members 560, 562. The frame 60 is covered with rectangular side faces 58. A core filler 59, preferably a honeycomb material, is installed inside the frame between the side faces. Each lower wall panel 52 preferably has a channel 56 formed along a top portion thereof. The wall panel side faces 58 extend beyond the frame 60 to form an end channel 62. A pair of lip portions 402, or inwardly extending ribs or ridges, are formed along an upper edge of each side of the channel 56. In a preferred embodiment as shown in FIG. 1, a U-shaped liner 400 is disposed in the channel 56, with the upper portion of each leg having an inwardly extending lip portion 402. A top surface 61 is formed along the top of the panel on each side of the channel 56.

Referring to FIG. 18, an upper draw block 110 has a pair of downwardly inclined draw surfaces 114 and an opening 112. The draw surfaces 114 are complementary to and are engaged with the draw surfaces 80 of the adjacent upper wedge blocks secured to the lower wall panels 52. As such, the draw surfaces are preferably formed at an angle of 45 degrees to the vertical, or 90 degrees to one another, and are preferably planar. Of course, it should be understood that the draw surfaces may be inclined at other angles so as to be complementary with the draw surfaces of the upper wedge blocks if those surfaces are inclined at another angle.

A lower draw block 120 similarly includes a pair of upwardly inclined draw surfaces 122 complimentary to the draw surfaces of the lower wedge blocks (preferably formed at 45 degree angles to the vertical, or 90 degrees to each other), and an upwardly extending post 124, preferably formed as an annular receiving member having a female threaded bore or opening 121. Alternatively, the post can be configured as a male threaded component, such as a stud. The draw surfaces 122 of the lower draw block are complementary to and are engaged with the draw surfaces 136 of the lower wedge blocks. It should be understood that the angles of the draw surfaces of the draw block can be inclined at angles other than those referenced in order to mate with the draw surfaces of the wedge blocks.

A draw rod 90 comprising a shaft 96 extends through the opening 112 in the upper draw block and includes a threaded lower end 98 that threadably engages the bore 121 in the lower draw block. A head portion 94 of the draw rod is received in a recess 113 formed in the top of the upper draw block and engages a surface formed in the bottom thereof. The head 94 has a hex shaped recess formed therein that is shaped to receive an Allan wrench or like tool. The draw rod 90 is rotated so as to threadably engage the lower draw block and thereby draw the pair of lower wall panels together as the draw surfaces 114, 122 of the upper and lower draw blocks engage the complementary draw surfaces 80, 136 on the upper and lower wedge blocks, respectively. Alternatively, it should be understood that the end of the draw rod can be configured with a female threaded opening dimensioned to receive the alternatively male threaded post of the lower draw block.

Referring to FIGS. 16 and 17, the lower wall panels are connected to the corner post by engaging the draw surface 136 of the lower wedge block 120 mounted to the lower wall panel with the complementary draw surface 268 of the lower draw block 260 mounted to the post member 202. The draw surfaces 114 of an upper draw block are then engaged with the complementary draw surfaces 80, 228 of the upper wedge blocks on the adjacent corner post and lower wall panel. A draw bolt 290, or short draw rod, is then passed through the opening 110 of the upper draw block and threadably engages the threaded opening 232 in the upper wedge block. The draw rod 290 is rotated so as to draw the lower wall panel 52 to the corner post as the complementary draw surfaces engage. Alternatively, it should be understood that the end of the draw rod can be configured with a female threaded opening dimensioned to receive the alternatively male threaded stud of the upper wedge block, as referred to above.

Alternatively, the hanger brackets installed on each end of the wall panels can have opposite upper and lower ends that are formed with inclined draw surfaces, preferably formed at a 45 degree angle from the vertical. In this embodiment, the ends of the hanger brackets take the place of the upper and lower wedge blocks, and the terms "upper wedge block" and "lower wedge block," as used herein, should be understood as also encompassing the upper and lower ends, respectively, of a hanger bracket so configured.

Notwithstanding the above description of the connector system used to connect the lower wall panels and corner post, it should be understood that the lower wall panels can be connected to one another, or to the corner post, in any number of ways not specifically described herein and that it is the connection of the upper stackable wall panels to one another and to the lower wall panels and the corner post, that is of primary importance, as will be hereinafter described.

Now referring to FIG. 1, wherein the pair of lower wall panels 52 connected in an end-to-end configuration are preferably connected in the manner described above with reference to FIG. 18, and the two right angle lower wall panels 52 are preferably connected to the corner post in the manner described above with reference to FIGS. 16–17, a pair of upper wall panels 500 are shown in an overlying position with the pair of lower wall panels 52 arranged in the end-to-end configuration.

Figure 10:
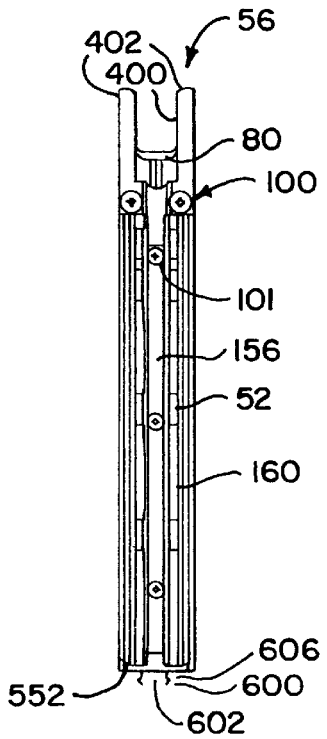
FIG. 10 is an end view of an upper wall panel.

In one embodiment, shown in FIG. 8, the upper wall panel 500 has a core with the same construction as the lower wall panel described above, and in particular, includes a core comprised of a frame 60, preferably made of wood, surrounding a honeycomb filler 59, preferably made of cardboard, with a pair of side faces 58, preferably made of hardboard, applied to each side of the frame over the filler. A fabric overlay is applied over the side faces. In addition, a flame-retardant scrim can be disposed between the fabric and side faces. The frame 60 is constructed from an upper and lower horizontal frame member 560, 562 and a pair of side vertical frame members 564 joined at the corners of the frame. The upper frame is hollowed out to form a channel 56 along a top portion thereof. As shown in FIGS. 1 and 10, a pair of lip portions, or inwardly extending ribs or ridges, are formed along an upper edge of each side of the channel. In a preferred embodiment, a U-shaped liner 400 is disposed in the channel 56, with the upper portion of each leg having an inwardly extending lip portion 402. A top cap 1300, shown in FIG. 1, includes a pair of downwardly extending resilient leg portions 1302 each having a ridge or rib 1304 that engages the opposing lip portions 402 of the upper channel. The top cap closes off the channel to protect the cables laid therein and to provide an aesthetically pleasing appearance.

As with the lower wall panels, an upper wedge block 70 is mounted to each end of the upper wall panel 500 along an upper portion thereof. A hanger bracket 150 is mounted to the end of the upper wall panel below the upper wedge block 70. In a preferred embodiment, the bottom edge of the hanger bracket is configured with a downwardly extending draw surface 552, which can function as a lower wedge block. Alternatively, a lower wedge block can be attached to the end of the upper wall panel below the hanger bracket as explained above with respect to the lower wall panel. Also as explained above, the hanger bracket alternatively can be configured with an upper end having an upwardly inclined draw surface, which can replace the upper wedge block. In addition, the hanger bracket 150 can be configured without accessory slots, as shown in FIG. 1, when it is desirable to make the upper wall panel non load bearing.

As shown in FIG. 10, an alignment clip 600 is mounted to the bottom frame member of the upper wall panel with a plurality of fasteners 602. Alternatively, the clip can be attached to the bottom frame member with adhesive or the like. In a preferred embodiment, the clip 600 extends along substantially the entire length of the bottom of the upper wall panel. The clip 600 is preferably extruded and made of rigid plastic, such as PVC, metal or a like resilient material. The clip 600 includes a pair of resilient leg portions 604 extending from a base. Each leg portion includes an outwardly extending ridge 606 portion that is shaped to engage the lip portion 402 formed along the upper edge of the channel in the lower wall panel 52.

Figure 9:
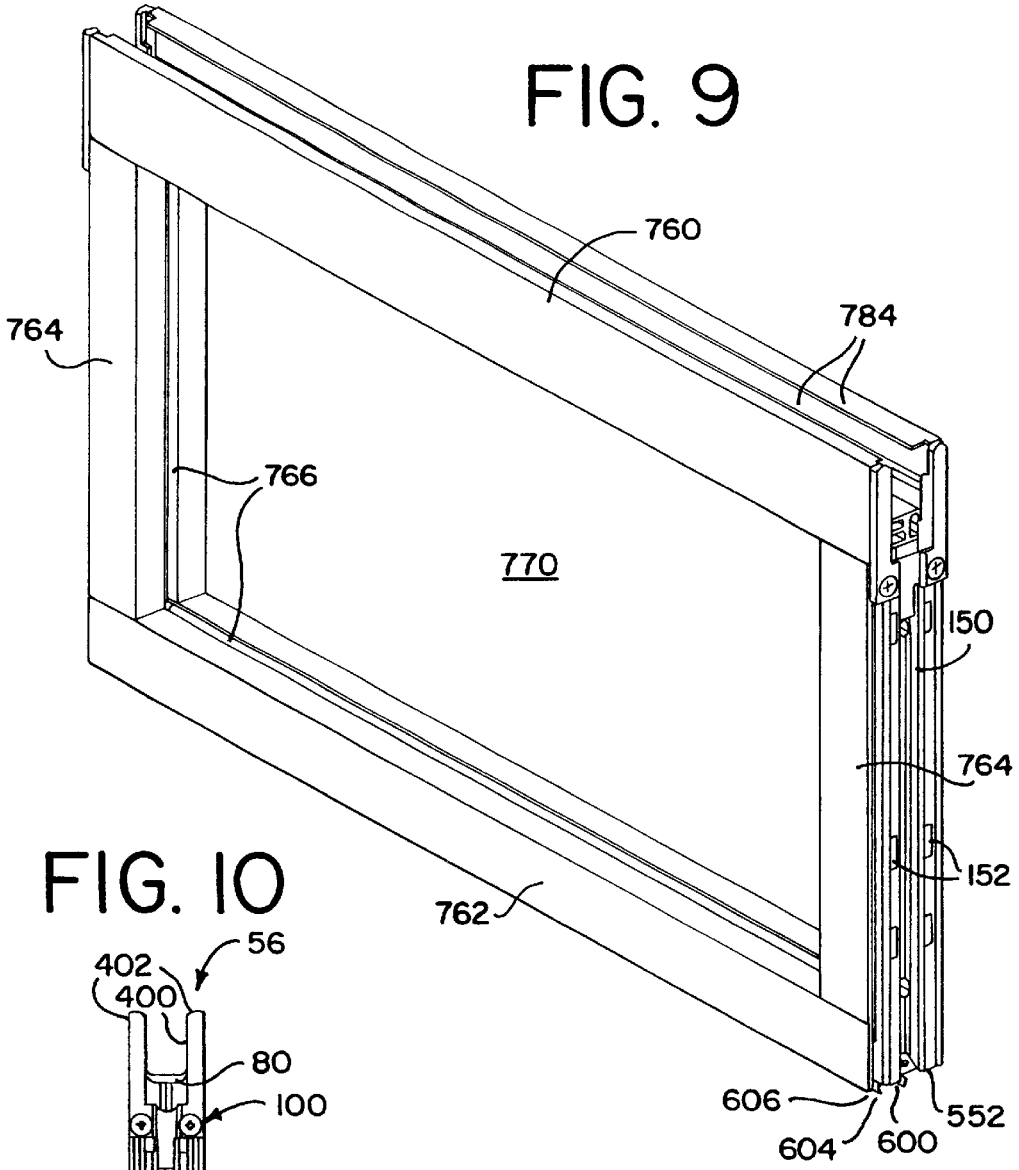
FIG. 9 is a perspective view of an alternative embodiment of an upper wall panel.

In an alternative embodiment of the upper wall panel, shown in FIG. 9, a lower and upper horizontal frame member 762, 760 are connected to a pair of vertical side frame members 764, e.g., with fasteners or by welding. Each frame member 760, 762, 764 is preferably an aluminum extrusion. In one embodiment, the frame members are joined with a plurality of gusset members (not shown in FIG. 9) positioned at each of the corners of the frame. Alternatively, the frame can be made of a single tubular member that extends around the entire periphery of the wall panel.

Figures 11, 12, 13, 14, 15:
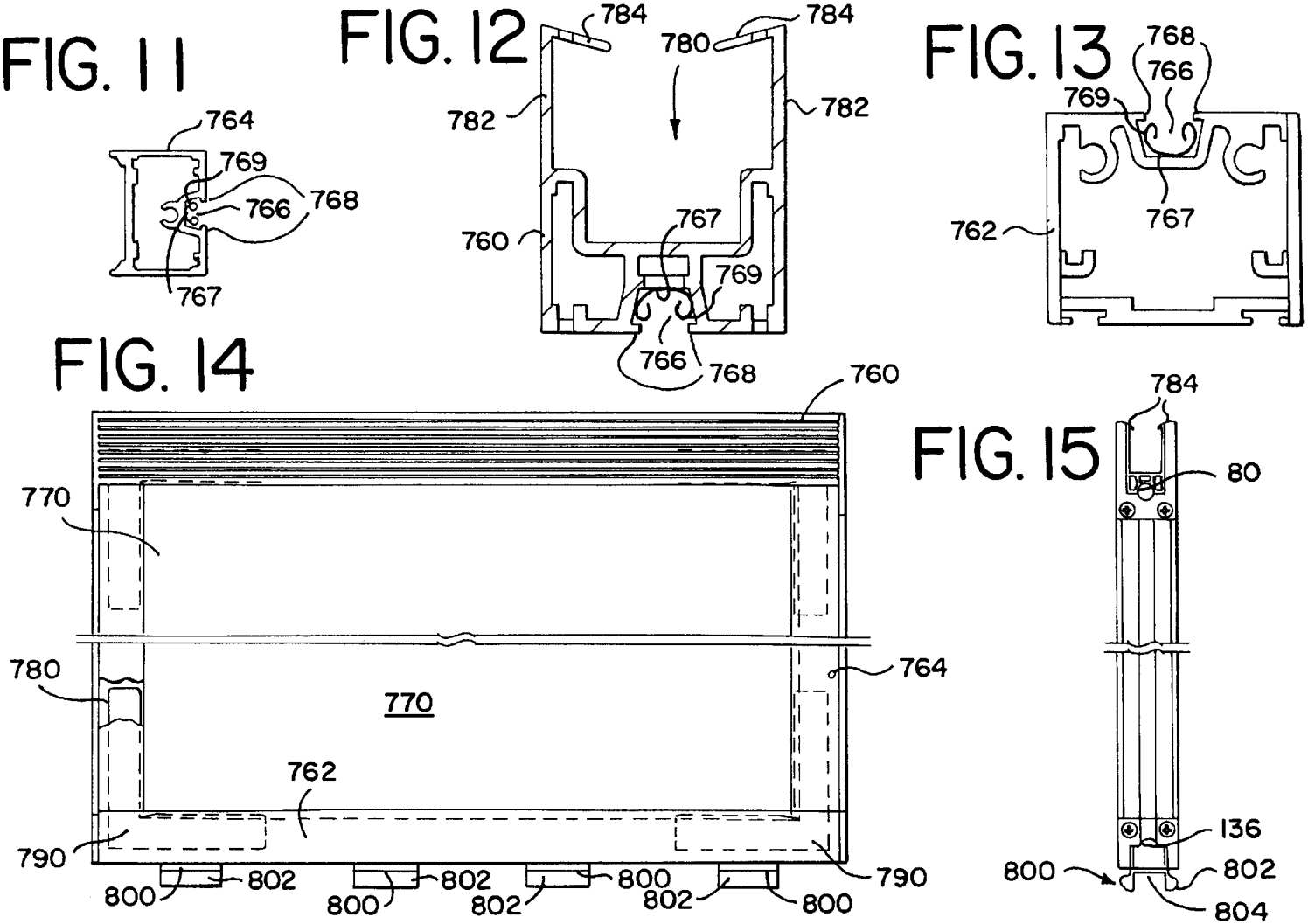
FIG. 11 is an end view of a vertical side frame member of the upper wall panel shown in FIG. 9.
FIG. 12 is an enlarged end view of an upper horizontal frame member of the upper wall panel shown in FIG. 9.
FIG. 13 is an enlarged end view of a lower horizontal frame member of the upper wall panel shown in FIG. 9.
FIG. 14 is a side view of an alternative embodiment of an upper wall panel.
FIG. 15 is an end view of the upper wall panel shown in FIG. 14.

As best shown in FIGS. 11–13, each frame member includes an inwardly facing channel 766 formed along one side thereof. A pair of engagement ribs 768 extend inwardly into the channel 766 along the periphery thereof. A plurality of plastic seal clips 767 can also be disposed in the channels preferably with one clip disposed in each channel and running substantially the length thereof. The seal clips 767 are generally U-shaped and include resilient leg portions with looped ends 769. When assembled, the channels 768 cooperate to form a channel around the inner periphery of the frame. A sheet 770 is installed in the channels 766, with the engagement ribs 768 concealing the seal clips and engaging the sides of the sheet to hold the sheet in the channel. In addition, the resilient legs of the seal clips 767 are biased outwardly to capture the edges of the sheet in each channel and hold the sheet firmly therein. In a preferred embodiment, the sheet is transparent, and can be made of glass, acrylic, plastic or like material. Alternatively, the sheet can be non-transparent, for example, wood, metal or reflective glass.

An alignment clip 600 is attached to the bottom of the lower horizontal frame member 762, and runs substantially the entire length thereof.

The top horizontal frame member 760, shown in FIG. 12, includes an upwardly facing channel 780 that serves as a wire management channel. A pair of legs 782 each include an inwardly facing flange 784. A top cap (shown in FIG. 1) can be installed to cover the channel, and preferably includes a pair of resilient leg portions 1302 having a ridge portion shaped to releasably engage the flanges.

In yet another embodiment of the upper wall panel, shown in FIGS. 14 and 15, the frame, comprised of bottom and top horizontal frame members 762, 760 and vertical side frame members 764, are joined with a plurality of gusset members 790 (referred to above) positioned at each of the corners of the frame. Each frame member includes an inwardly facing channel 766 that receives a sheet 770 as described above. In this embodiment, the sides of the upper frame member are provided with a plurality of horizontal grooves or lines for aesthetic reasons. Alternatively, the sides of the frame member can be planar or unadorned. A plurality of alignment clips 800 are attached to the bottom frame member in a spaced apart relationship along the bottom of the upper wall panel. Each alignment clip 800 includes a base, which is mounted to the bottom of the wall panel with fasteners 804, adhesive and the like, and a pair of resilient wing portions 802 that are shaped to engage the lip portions 402 formed along the upper edge of the channels 56 on the lower wall panels 52.

Figure 2:
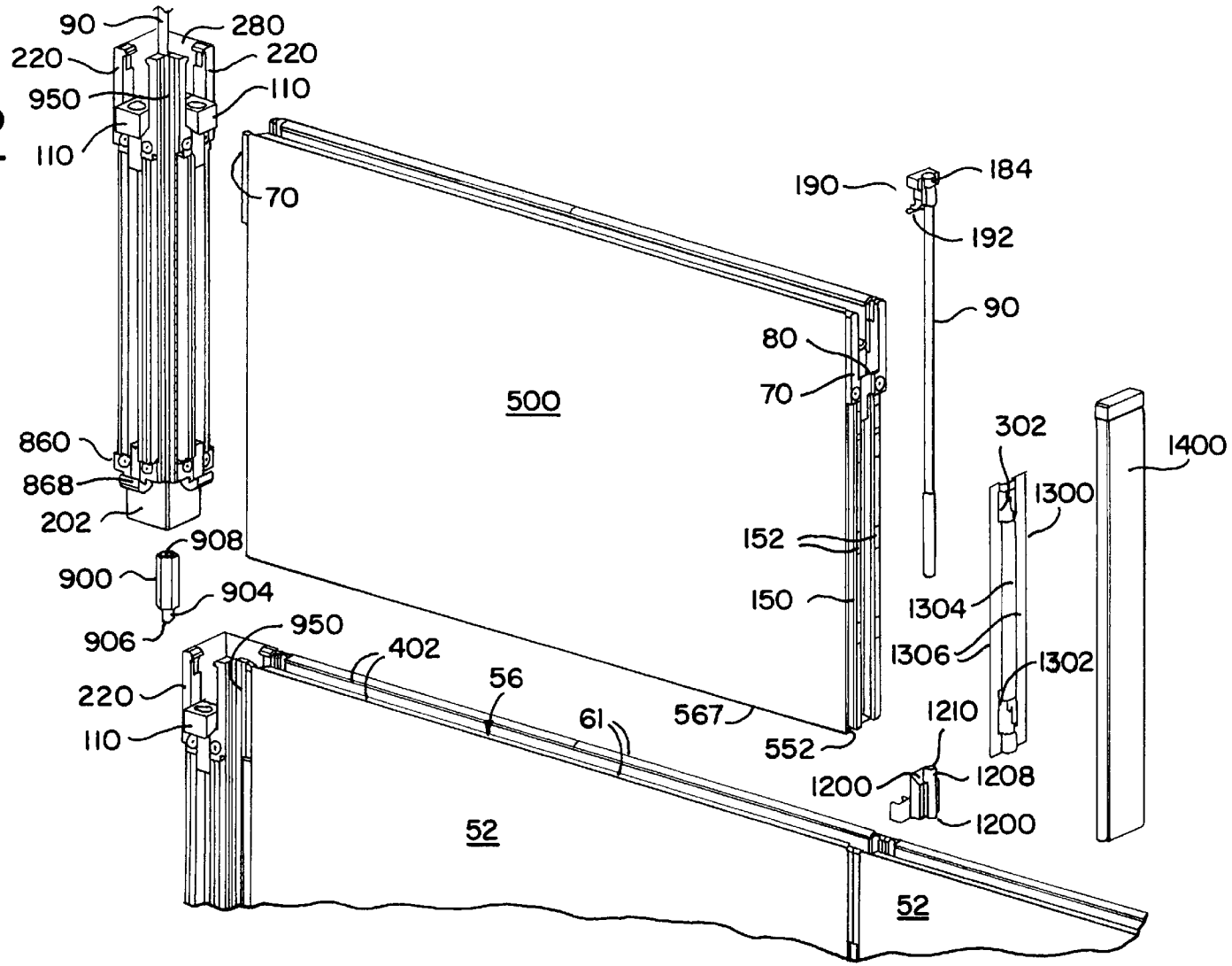
FIG. 2 is an exploded perspective view of another configuration of a stackable wall panel system including an upper wall panel overlying a pair of lower wall panels.
Figure 3:
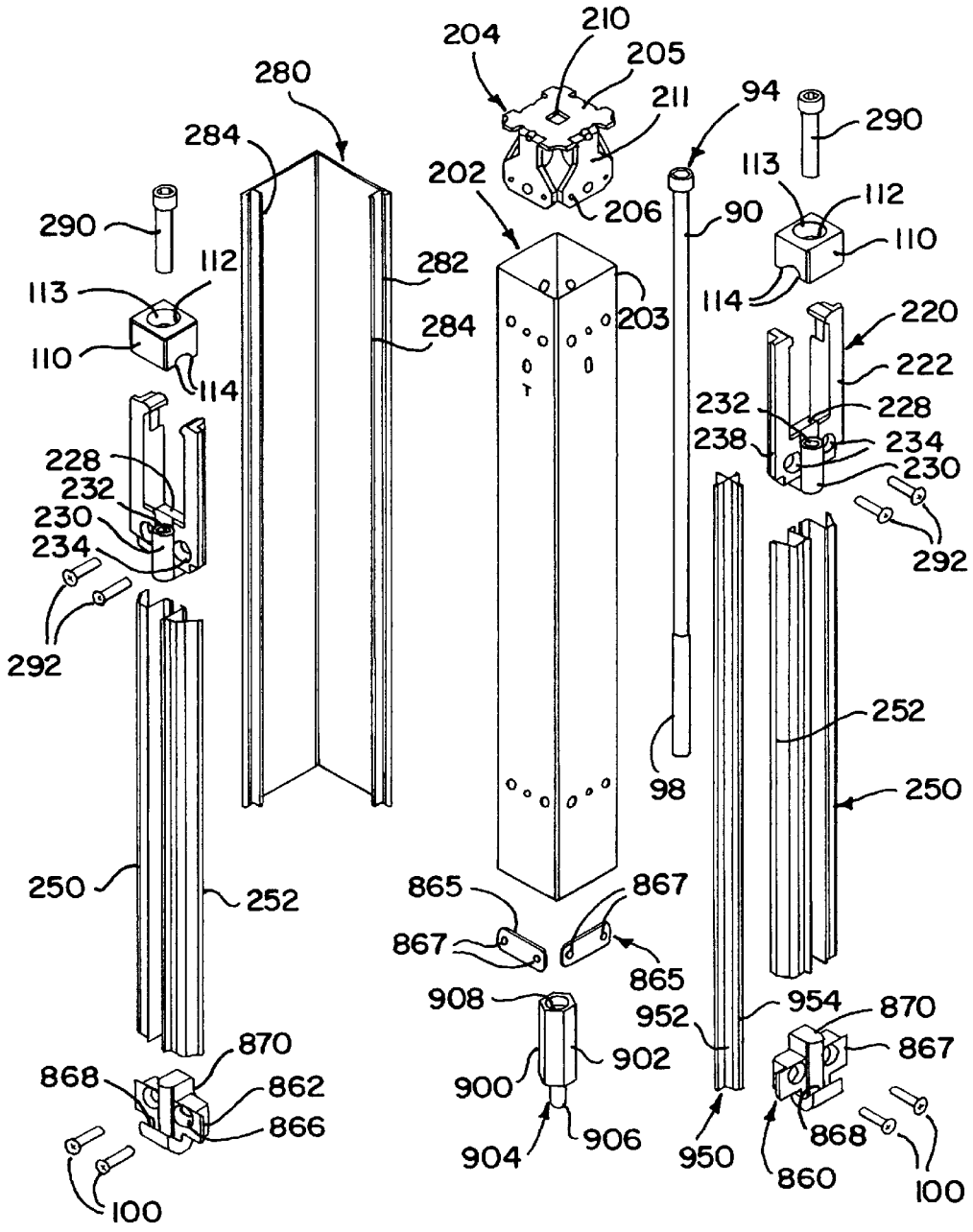
FIG. 3 is an exploded perspective view of a first embodiment of an upper corner post and connector system.

Now referring to FIGS. 1–3, one embodiment of an upper corner post extension is shown. The corner post is of similar construction to the lower corner post described above with respect to FIGS. 16 and 17. In particular, the corner post includes a post member 202 configured as a tube and a bracket 204 having a horizontal plate 205 mounted in the upper portion of the tube. The tube is preferably made from a single piece of metal formed into a tube and joined along one corner 203 thereof, preferably by welding. An upper wedge block 220 is mounted to each side of the tube that is intended to be connected with an adjacent upper wall panel. A lower draw block 860 is mounted to each side of the tube along a bottom portion thereof below the upper wedge block. A pair of washer plates 865 are installed inside the tube and include threaded openings 867 for receiving the screws 100. The lower draw block 860 includes a base 870, a stop flange 862 and screw holes 866.

The lower draw block 860 further includes a draw portion having an upwardly inclined draw surface 868. Preferably, the draw surface is inclined at an angle of 45 degrees and is planar, although it should be understood that other angles would also work. A filler extrusion 250, having a W-shaped cross section with flanges 252, is attached to the post member 202 between the upper wedge blocks and the lower draw block.

One or more covers 280 are installed along the sides of the tube that are not configured with upper and lower wedge blocks for connection with an adjacent upper wall panel. As shown for example in FIG. 3, the cover includes a pair of flanges 282 having a hook flange 284 that engages a resilient flange 252 formed along each side of the extrusion 250. The cover can be flat, so as to cover only a single side of the corner post, or it can be formed with two walls, comprising a body, extending from each other at substantially a right angle.

Referring to FIGS. 1–3, an insert 900 includes a body 902 preferably having a hexagonal cross-section, which is shaped to be received by a tool, such as a wrench. It should be understood that other shapes, such as a square or circular cross section (e.g., with knurling or similar grippable surface) would also work. A threaded stud portion 904 having a tapered tip 906 extends from one end of the body, while an opposite end of the body includes a longitudinally extending threaded opening or bore 908. In a preferred embodiment, the threaded stud portion 904 acts as a tap, with the tapered tip initially locating the insert in the opening, and forms threads in the square opening 210 in the horizontal plate 205 of the bracket 204 as the insert 900 is threaded into the square opening 210. Accordingly, the insert is preferably made of hardened steel or like material capable of tapping the bracket, which is preferably made of metal.

Alternatively, the lower corner post can be provided with a threaded opening, circular or otherwise, which receives the threaded portion of the insert.

Alternatively, either or both ends of the insert body can be configured as either a threaded stud or a threaded opening. For example, where the lower corner post includes an upwardly extending male threaded stud, as discussed above, the mating lower end of the insert includes a threaded opening configured to operatively mate with the stud. Similarly, if the draw rod engaging the top end of the insert includes a female threaded opening, the mating top end of the insert is configured as a male threaded stud configured to mate therewith.

Also shown in FIG. 3 is a filler extrusion 950 having an X-shaped cross section. Each leg 952 of the extrusion includes an end portion 954 shaped to engage the flange of the extrusion. In this way, the filler extrusion 950, or inner corner cover, is engaged with the filler extrusions 250 attached along adjacent sides of the corner post and with the flanges of the upper and lower wedge blocks.

During installation, the insert 900 is threaded into the opening 210 in the lower corner post, either by way of the self-tapping methodology described above or by engagement with a pre-threaded opening. The upper corner post, which is configured as a hollow tube 202 without a bottom bracket, is then disposed over the insert 900 and into engagement with the top of the lower corner post as it rests thereon. A connector, preferably configured as a draw rod 90, is inserted through the opening 210 in the plate member 205 of the bracket in the upper corner post and is threadably engaged with the top end of the insert at opening 908. In this way, the upper corner post can be installed on the lower corner post without having to remove the upper draw blocks 110 and draw rods 290 engaged with the lower corner post and any connected lower wall panel.

As explained above, in the preferred embodiment, the lower end 98 of the draw rod includes a male threaded portion that threadably engages the threaded opening 908 in the insert, although it should be understood that the draw rod could include a female threaded portion that threadably engages a male threaded stud extending upwardly from an end of the insert. With either embodiment, the draw rod is tightened by rotation to clamp the upper corner post to the lower corner post.

Figure 4:
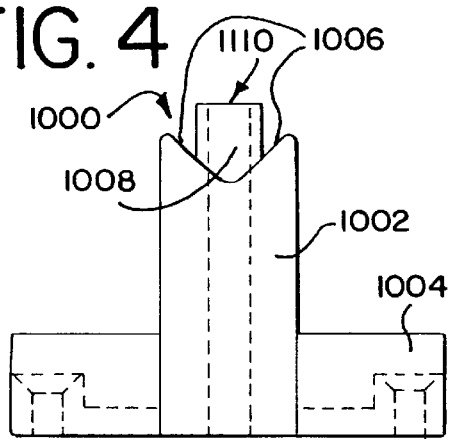
FIG. 4 is a side view of a first embodiment of a draw block.
Figure 5:
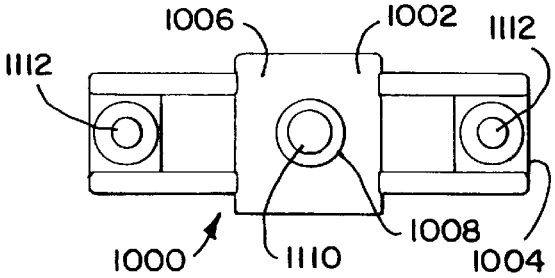
FIG. 5 is a top view of the draw block shown in FIG. 4.

Referring to FIGS. 1 and 4–5, a draw block 1000, preferably made of aluminum or like material, is shown as including a body portion 1002 and a pair of feet 1004 extending laterally from the body. Each foot includes a opening 1112. The body 1002 includes a pair of upwardly facing or inclined draw surfaces 1006 formed on a top thereof, and further includes a post 1008, configured as an annular receiver with a threaded opening 1110 therein. The draw surfaces are preferably planar and are inclined at an angle of approximately 45 degrees to the vertical (with the pair of faces forming an angle of 90 degrees). Alternatively, the post can be comprised as a threaded stud, depending on whether the mating draw rod is configured with a female threaded opening, or a male threaded portion. The draw block 1000 is disposed in the channels 56 formed along the top of the pair of lower wall panels connected in an end-to-end configuration, with the body 1002 of the draw block overlying the interface of the two lower wall panels, which are preferably attached as explained above with reference to FIG. 18. The feet 1004 of the draw block are attached to the upper frame member of the adjacent lower wall panels with a screw or like fastener. The draw block 1000 can be attached to the two lower wall panels without removing the draw rod 90 or the upper draw block 110 connecting the two lower wall panels.

To install the pair of upper wall panels as shown in the configuration of FIG. 1, a first upper wall panel is disposed on top of the lower wall panel connected to the lower corner post. The bottom 567 of the upper wall panel rests on the top 61 of the lower wall panel with the resilient portions 604 of the clip engaged with the lip portion 402 formed along the upper edges of the channel. In a preferred embodiment, the draw surfaces 552 of the hanger bracket secured to the end of the upper wall panel adjacent the upper corner post are not engaged with the draw surfaces 868 of the lower draw block attached to the corner post. Rather, the draw surfaces are slightly spaced apart to provide for a slight clearance therebetween, e.g., from about 1/64 to 1/8 inch. Similarly, the draw surfaces 552 formed along the bottom of the hanger bracket are spaced above the draw surfaces 1006 of the draw block. As such, in this embodiment, the draw surfaces 868, 1006 on the lower draw blocks and on the lower end of the hanger bracket are not needed to connect the upper wall panel to the lower wall panel or to the upper corner post. However, the draw surfaces of each of those members serves as a light seal to prevent light from seeping from one side of the wall panel system to the other side thereof. In addition, the closely mating but separated draw surfaces provide the appearance of engagement which improves the aesthetics of the system.

As the draw rod 90 is tightened to draw the draw surfaces 114 of the upper draw block into engagement with the draw surfaces 228, 80 of the upper wedge blocks of the upper corner post and the upper wall panel, the bottom of the upper wall panel is clamped against the top of the lower wall panel to provide for a core compression of the upper wall panel 500. Similarly, the next adjacent upper wall panel can be disposed on the underlying lower wall panel with the alignment clip 600 engaging the lip portions 402 and with the draw surfaces 552 of the hanger bracket spaced apart from the draw surfaces 1006 of the draw block. Again, as the draw surfaces 114 of the draw block 110 are engaged with the complementary draw surfaces 80 of the upper wedge blocks on the adjacent upper wall panels, the bottoms 567 of the upper wall panels are clamped against the tops 61 of the lower wall panels, so as to thereby eliminate any gaps formed therebetween and any attendant seepage of light between the lower and upper wall panels.

Alternatively, it should be understood that the lower draw blocks, or the hanger frames or lower wedge blocks, could be configured such that the respective complimentary draw surfaces are engaged and thereby clamp the upper wall panels to the lower draw blocks, as opposed to clamping them to the top of the lower wall panels.

Figure 6:
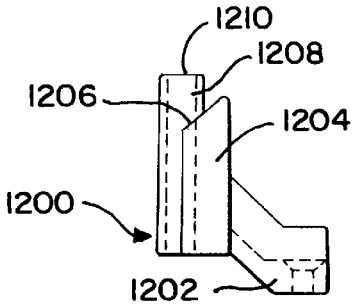
FIG. 6 is a side view of a second embodiment of a draw block.
Figure 7:
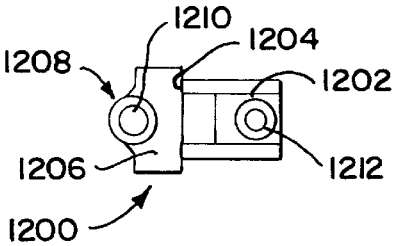
FIG. 7 is a top view of the draw block shown in FIG. 6.

Referring to FIG. 2, an end-run upper wall panel 500 is shown attached to an upper corner post. In this configuration, a lower draw block 1200, shown in FIGS. 6 and 7, is mounted in the channel 56 of the underlying lower wall panel. The draw block 1200 includes a foot portion 1202 with a hole 1212 and a body portion 1204 that extends outwardly and upwardly from the foot portion. The foot portion 1202 preferably is mounted to the upper frame member 560 of the lower wall panel with a fastener that extends through hole 1212. The draw block 1200 includes a downwardly inclined draw surface 1206 and a post 1208 formed as an annular receiving portion having threaded opening 1210 or bore. As with the other draw blocks, the draw surfaces is preferably planar and inclined at approximately 45 degrees from the vertical. Alternatively, the post can be configured as a male threaded stud, depending on the configuration of the mating draw rod, as explained above.

A modified upper draw block 190 includes a downwardly extending draw surface 192 and an opening 184. A draw rod 90 extends through the opening and engages the draw block as the head of the draw rod is received in a recess formed therein. The draw rod 90 is threadably engaged with the lower draw block 1200 and can be tightened to clamp the bottom 567 of the upper wall panel to the top 61 of the lower wall panel, again with the resilient portions 604 of the alignment clip engaging the lip portions 402 of the channel. In a preferred embodiment, the draw surfaces of the hanger bracket 552 are spaced above the draw surface 1206 of the lower draw block so as to ensure that there is core compression, although it should be understood that the hanger bracket and draw block could be positioned or configured so as to ensure that the draw surfaces engage, whereby the upper wall panel is clamped to the draw block.

Referring to FIG. 2, a clip 1300 includes two pairs of laterally extending hook members 1302 that are received in and engage the slots 152 formed in the front of the hanger bracket 150. The clip 1300 further includes an arcuate portion 1304 and a pair of flanges 1306 that extend outwardly therefrom. The arcuate portion 1304 has a radius sufficient to allow the clip to be disposed over the draw rod 90 as the clip is mounted on the hanger bracket. In one suitable embodiment, the radius is 0.25 inches. A cover member 1420 is then installed on the clip by way of engagement with the flanges. The cover can be relatively shallow, or deep so as to provide a cable management passageway.

In an alternative embodiment, preferably used with shorter upper wall panels, as best shown in FIGS. 24–27, a clip 1400 includes only one pair of laterally extending hook members 1402, which each include a hook portion 1404 that extends through an opening 1406 in a body 1408 of the clip, and a base 1410 portion that is attached to the body with a pair of rivets, or like fasteners, or by welding and the like. The body 1408 of the clip includes a channel 1412 that is dimensioned to be nested in the channel 156 of the hanger bracket as the hook portions 1404 engage the slots 152 formed in the front of the hanger bracket 150 and a pair of outwardly extending flanges 1414. In this way, the clip can be installed behind the draw rod 90, and does not need to be removed before the draw rod is removed. The cover member 1420 is installed on the clip 1400 by engaging the outwardly extending flanges thereof. The clip is preferably roll formed steel, although it should be understood that other materials, such as aluminum or plastic, and methods of manufacture, such as extrusion or molding, would also work.

Now referring to FIGS. 20–23, a second embodiment of the upper corner post is shown as providing for a top-to-bottom, double high configuration of stackable upper wall panels. In particular, the upper corner post is substantially the same as the single high upper corner post described above with reference to FIGS. 1–3, except that the post further includes a first upper wedge block 220 attached to a side of the post member between the lower draw block 860 and a second upper wedge block 220, which is secured to the tube near the upper end thereof. A pair of filler extrusions 250 are attached to each side of the post member between the lower draw block 860 and the first upper wedge block 220 and between the first and second upper wedge blocks 220. A pair of washer plates 865 are installed inside the tube and include threaded openings 867 for receiving screws that secure the first upper wedge block to the post member. An opening 221 is provided in the side of the tube so as to enable the installer to manually hold the plates 865 in place while the fasteners are threaded therein.

Figures 21, 22, 23:
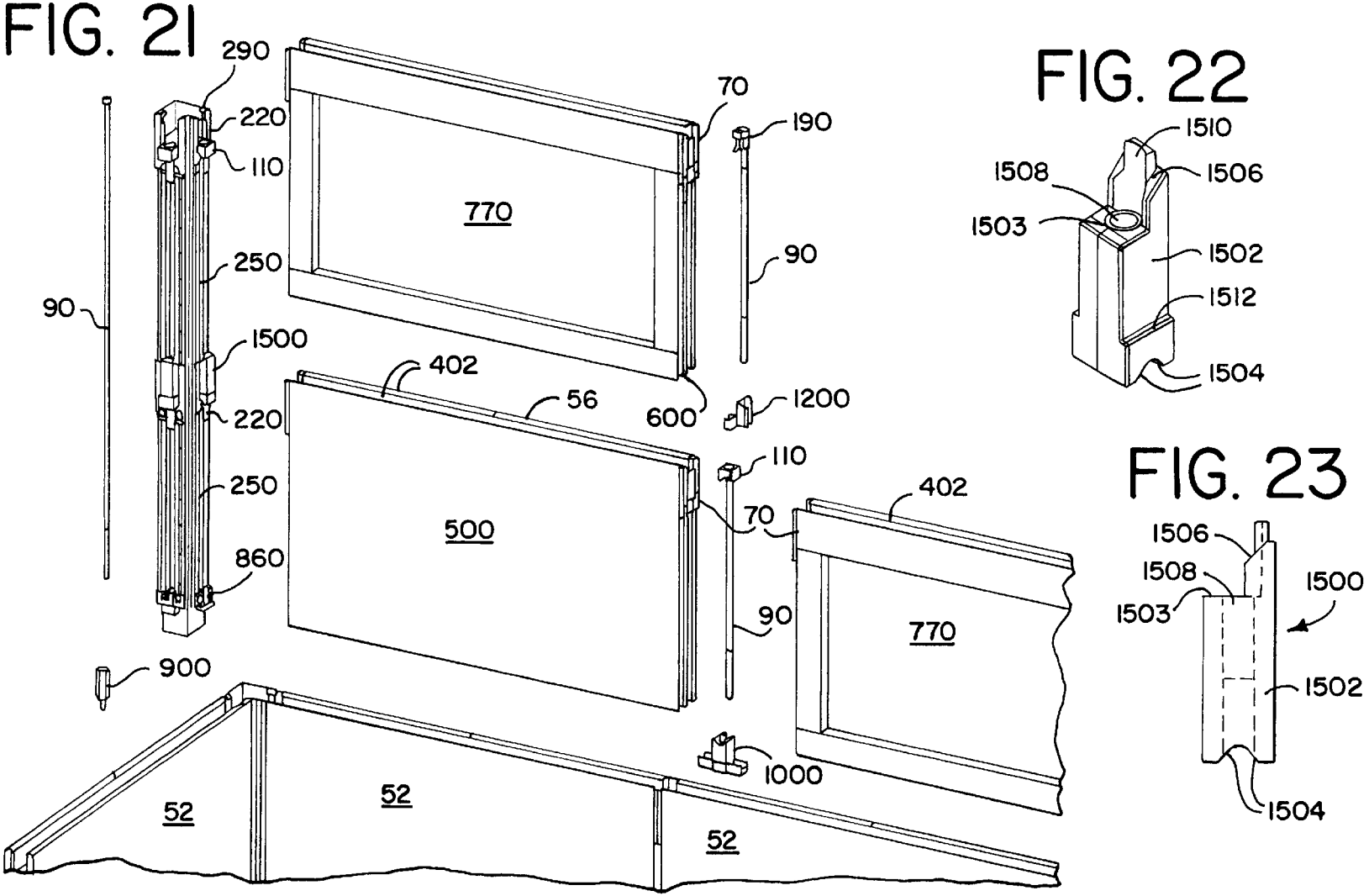
FIG. 21 is a perspective view of a pair of upper wall panels being connected in a top-to-bottom, double high configuration, with a third upper wall panel connected to a first upper wall panel in an end-to-end configuration.
FIG. 22 is a perspective view of an intermediate draw block used to connect an upper wall panel in the double high configuration shown in FIG. 21.
FIG. 23 is a side view of the intermediate draw block shown in FIG. 22.

As best shown in FIG. 21, during installation, the upper corner post is disposed on the lower corner post over the insert 900, and secured thereto with a draw rod 90. A first upper wall panel 500 is then secured to the upper corner post and an underlying lower wall panel in the manner described above, except that an intermediate draw block 1500 is used to connect the upper wall panel to the upper corner post.

The intermediate draw block includes a body 1502 with a pair of downwardly inclined draw surfaces 1504, preferably planar and formed at an angle of 45 degrees to the vertical (or 90 degrees to each other). The draw block further includes an upwardly inclined draw surface 1506, also preferably planar and formed at an angle of 45 degrees to the vertical. The body 1502 includes a longitudinal opening 1508 passing therethrough, a top 1503, an upwardly extending tab 1510 and a pair of ledges 1512 formed along each side thereof. The draw surfaces 1504 engage the wedge surface 228 of the first upper wedge block secured to the post member and the wedge surface 80 of the upper wedge block secured to the first upper wall panel. A draw rod 291, which is slightly longer than draw rod 290, is inserted through the opening 1502 and threadably engages the first upper wedge block 220 to draw the first upper wall panel to the post member and to the lower wall panel. The head of the draw rod 291 engages the top 1503 of the body 1502. The tab 1510 serves both as a light seal and to align the second upper wall panel as the tab fits inside the channel 156 of the hanger bracket attached thereto.

A draw block 1200 is then attached to the first upper wall panel 500 in the channel 56 formed along the top portion thereof, as explained above with reference to the lower wall panels. A second upper wall panel, with an alignment clip 600 secured to the bottom thereof, is then disposed on the first underlying upper wall panel such that the resilient portions 604 of the clip engage the lip portions 402 formed on the first tipper wall panel. Draw rods 90, 290 and upper draw blocks 110, 190 are installed to secure the second upper wall panel to the draw block 1200 and to the second upper wedge block in the manner described above with respect to the first lower wall panel. In particular, the draw rod 290 connects the upper draw block 190 and the second upper wedge block 220 and the draw rod 90 connects the draw block 110 and the lower draw block 1200 secured to the first upper wall panel. The draw surface 552 formed along the bottom of the hanger bracket connected to the second upper wall panel is spaced slightly apart from the draw surface 1506 of the intermediate draw block. Alternatively, the intermediate draw block and hanger bracket can be configured such that the complimentary draw surfaces engage one another.

Although the Figures show only a single second upper wall panel stacked double high on a first upper wall panel, it should be understood that two or more second upper wall panels can be installed end-to-end on underlying first upper wall panels installed end-to-end (further installed on lower wall panels installed end-to-end) using draw blocks 1000 and draw rods 90 as described above with respect to the single-high upper wall panels. It should also be understood that the upper post could be further configured to accommodate three or more upper wall panels stacked bottom-to-top by providing three or more pairs of lower draw blocks and upper wedge blocks respectively. Likewise, additional upper wall panels, e.g., three or more, can be stacked one on top of the other in an end-to-end configuration in accordance with the aforementioned description.

In an alternative embodiment, the lower corner post is removed from the assembly and a new corner post having a height equal to the combined height of the lower wall panel and any number of upper wall panels is installed in its place. In such an embodiment, the insert is not used, although such a configuration requires disassembly of the lower wall panel system. The single height corner post is provided with a lower draw block and upper wedge blocks to allow it to connect with the lower wall panel and any number of upper wall panels.

Figure 28:
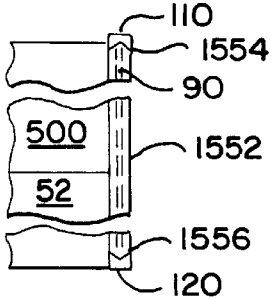
FIG. 28 is a side view of an alternative connection of an end-run upper wall panel and an end-run lower wall panel.
Figure 25:
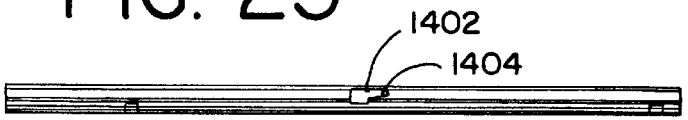
FIG. 25 is a side view of the clip shown in FIG. 24.
Figure 26:
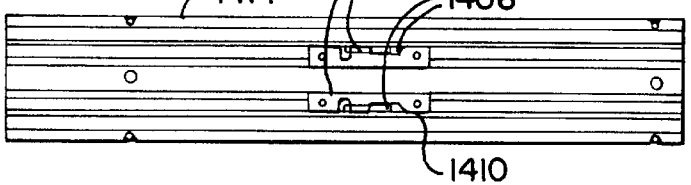
FIG. 26 is a front view of the clip shown in FIG. 25.
Figure 27:
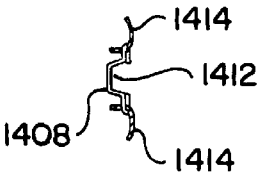
FIG. 27 is an end view of the clip shown in FIG. 25.
Figure 24:
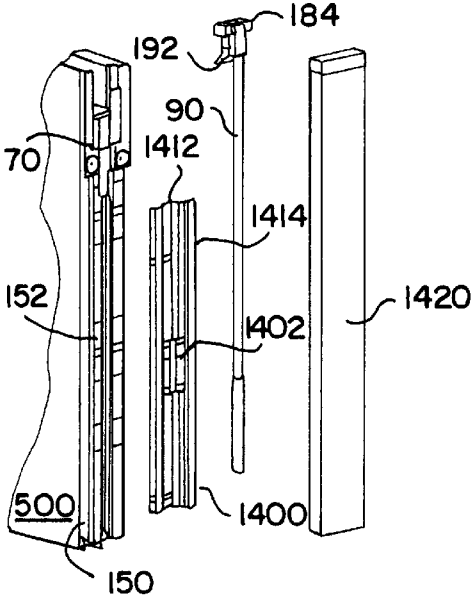
FIG. 24 is a partial perspective view of an end of the upper wall panel shown in FIG. 22 with an alternative embodiment of a clip for engaging a cover member.

In yet another embodiment, shown in FIG. 28, a stand alone hanger bracket 1552 having a height equal to the combined height of an end-run lower wall panel 52 and a stackable upper wall panel 500 is abutted against the hanger brackets of the lower and upper wall panels. An upper draw block 110 is engaged with the draw surface of the upper wedge block 70 secured to the upper wall panel and with the hanger bracket, which preferably has an upwardly inclined draw surface 1554. A lower draw block 120 is engaged with the draw surface of the lower wedge block 30 secured to the lower wall panel and with the hanger bracket 1552, which further preferably includes a downwardly inclined draw surface. A draw rod 90 is then engaged between the upper and lower draw blocks 110, 120 to draw the upper wall panel to the lower wall panel. A cover can then be secured to the stand alone hanger bracket 1552, which is inverted.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A system of wall panels comprising:

a first post comprising an upper portion;

an insert having a first end threadably engaging said upper portion and a second end extending upwardly therefrom;

a second post disposed on said first post over said insert;

a connector engaging said second post member and threadably engaging said second end of said insert;

at least one lower wall panel connected to said first post; and at least one upper wall panel overlying said at least one lower wall panel and connected to said second post.

2. The system of claim 1 said upper portion of said first post has an opening formed therein and wherein said first end of said insert comprises a threaded portion threadably engaging said opening.

3. The system of claim 2 wherein said opening is initially unthreaded, and wherein said threaded portion of said insert is self tapping in said initially unthreaded opening so as to form threads in said opening and thereafter be threadably engaged with said opening.

4. The system of claim 1 wherein said second end of said insert has a threaded opening and wherein said connector comprises a draw rod threadably engaging said threaded opening.

5. The system of claim 1 further comprising an upper draw block having a pair of draw surfaces and a draw rod; and wherein said second post comprises an upper wedge block having a threaded opening mounted thereto, said upper wedge block comprising a draw surface; and wherein said upper wall panel comprises a pair of upper wedge blocks mounted on opposite sides thereof, each of said upper wedge blocks of said upper wall panel comprising a draw surface, said draw surfaces of said upper draw block engaging said draw surfaces of said upper wedge blocks mounted on adjacent sides of said upper wall panel and said second post, said draw rod engaging said upper draw block and threadably engaging said threaded opening of said upper wedge block mounted to said second post.

6. The system of claim 1 wherein said second post comprises a tube having a plate secured inside said tube, wherein said connector engages said plate.

7. The system of claim 1 wherein said connector comprises a draw rod.

8. A system of wall panels comprising:

a lower wall panel having a top;

a first draw block having a threaded portion, said first draw block mounted to said top of said lower wall panel adjacent one end thereof;

a second draw block having a draw surface;

a draw rod; and an upper wall panel overlying said lower wall panel, said upper wall panel comprising a bottom engaged with said top of said lower wall panel, and a pair of upper wedge blocks mounted to said upper wall panel on opposite ends thereof with one of said upper wedge blocks overlying said first draw block, each of said upper wedge blocks comprising a draw surface, said second draw block engaging said draw surface of said upper wedge block overlying said first draw block, and said draw rod connecting said first and second draw blocks as said draw rod threadably engages said threaded portion of said first draw block.

9. The system of claim 8 wherein said lower wall panel comprises a channel formed along said top thereof and a lip portion formed along an upper edge of said channel, and wherein said upper wall panel comprises a clip attached to a bottom thereof, said clip comprising a resilient portion engaged with said lip portion as said upper wall panel is disposed on said lower wall panel with said bottom of said upper wall panel engaged with said top of said lower wall panel.

10. The system of claim 8 further comprising a cover attached to said end of said upper wall panel over said draw rod.

11. A system of wall panels comprising:

a pair of lower wall panels connected to one another in an end-to-end configuration, each of said lower wall panels having a channel formed along a top portion thereof and comprising a lip portion formed along an upper edge thereof;

a pair of upper wall panels overlying said lower wall panels in an end-to-end configuration, each of said upper wall panels comprising an clip mounted to a bottom of each of said upper wall panels, said clips each comprising a resilient portion;

wherein said upper wall panels are disposed on said lower wall panels with said resilient portion of each of said clips engaging said lip portion of said lower wall panels;

a first draw block disposed in said channels of said lower wall panels and attached to said top portions thereof;

a second draw block having a pair of draw surfaces; and a draw rod;

wherein each of said upper wall panels further comprises a pair of upper wedge blocks mounted to each of said upper wall panels on opposite sides thereof, each of said upper wedge blocks comprising a draw surface, said second draw block engaging said draw surfaces of said upper wedge blocks mounted on adjacent sides of said upper wall panels and said draw rod connecting said first and second draw blocks.

12. The system of claim 11 wherein said first draw block comprises a pair of feet and a body portion extending upwardly therefrom, wherein said feet are mounted to said top portions of said first and second lower wall panels respectively.

13. The system of claim 12 wherein said first draw block further comprises a threaded portion formed in said body portion, said threaded portion threadably engaged with said draw rod.

14. The system of claim 11 wherein said clip extends substantially along the entire length of the bottom of the upper wall panel.

15. The system of claim 11 wherein said clip comprises a pair of downwardly extending resilient portions, and wherein said lower wall panels each comprise a pair of lip portions formed along opposite sides of the upper edge of said channel, each of said resilient portions having a ridge portion shaped to engage one of said lip portions.

16. The system of claim 15 wherein said clip has an inverted U-shape.

17. The system of claim 11 wherein at least one of said upper wall panels comprises a rectangular frame comprising an upper and lower horizontal rail and a pair of vertical stiles, said upper and lower rails and said vertical stiles connected at their respective ends to form said rectangular frame, said frame having an inwardly facing channel formed around at least a portion of an inner periphery of said frame, said channel shaped to receive a sheet member, said sheet member disposed in said channels.

18. The system of claim 17 wherein said sheet member is transparent.

19. A method for mounting an upper corner post to a lower corner post comprising:

providing said lower corner post comprising an upper portion;

providing an insert having an end portion;

threadably engaging said end portion of said insert with said upper portion of said lower corner post;

disposing said upper corner post on said lower corner post over said insert;

connecting said upper corner post to said insert with a connector.

20. The method of claim 19 wherein said upper portion comprises an unthreaded opening and wherein said end portion of said insert comprises a threaded stud, and wherein said threadably engaging step further comprises tapping said unthreaded opening with said threaded stud.

21. The method of claim 20 wherein said unthreaded opening is square.

22. The method of claim 19 wherein said insert has a threaded opening in an end opposite said threaded end portion and wherein said connector comprises a draw rod having a threaded portion and a head, wherein said connecting step further comprises threadably engaging said threaded opening with said threaded portion of said draw rod and engaging said upper corner post with said head.

* * * * *